US010709995B1

(12) United States Patent
Smith

(10) Patent No.: US 10,709,995 B1
(45) Date of Patent: Jul. 14, 2020

(54) STEERABLE TOY CAR APPARATUS

(71) Applicant: Geoffrey Smith, San Rafael, CA (US)

(72) Inventor: Geoffrey Smith, San Rafael, CA (US)

( * ) Notice: Subject to any disclaimer, the term of this patent is extended or adjusted under 35 U.S.C. 154(b) by 0 days.

(21) Appl. No.: 16/533,022

(22) Filed: Aug. 6, 2019

(51) Int. Cl.
*A63H 17/38* (2006.01)
*A63H 17/36* (2006.01)
*A63H 7/04* (2006.01)
*A63H 17/26* (2006.01)

(52) U.S. Cl.
CPC ..... *A63H 17/38* (2013.01); *A63H 7/04* (2013.01); *A63H 17/262* (2013.01)

(58) Field of Classification Search
CPC ..... A63H 17/38; A63H 17/262; A63H 7/04; A63H 17/05; A63H 11/10; A63H 17/002; A63H 17/266; A63H 17/36; A63H 29/00; B62B 11/00
USPC ..... 446/244, 251, 265, 267, 279, 451, 465, 446/466
See application file for complete search history.

(56) References Cited

U.S. PATENT DOCUMENTS 1,333,216 A * 3/1920 Pajeau ..... A63H 33/00 446/451
1,356,333 A * 10/1920 Beach ..... A63H 17/02 446/279
2,008,453 A * 7/1935 Kalfur ..... A63H 7/04 446/325
2,501,206 A * 3/1950 Brackett, Jr. ..... A63H 17/38 446/451
2,647,343 A 8/1953 Zileri
3,777,392 A * 12/1973 Span ..... A63H 17/002 446/78
4,016,675 A 4/1977 Drucker
4,317,307 A * 3/1982 Conry ..... A63H 17/38 280/47.34
4,595,380 A * 6/1986 Magers ..... A63H 17/38 446/437
4,741,718 A * 5/1988 Moolman ..... A63H 17/38 446/451
5,240,451 A * 8/1993 Clark, Jr. ..... A63H 17/38 446/431
5,882,241 A * 3/1999 Mullaney ..... A63H 17/004 446/454
6,272,946 B1 * 8/2001 Roux ..... A63H 17/38 446/451
6,488,563 B1 12/2002 Isaacson
6,949,000 B1 9/2005 Antoine
D676,495 S 2/2013 Soth
9,039,484 B1 * 5/2015 Mayson ..... A63H 17/05 280/47.11

(Continued)

*Primary Examiner* — Nini F Legesse

(57) ABSTRACT

A steerable toy car apparatus for providing an engaging toy for children includes a body having a front cutout channel, a back cutout channel, a front crossmember, and a back crossmember. A front left wheel and a front right wheel have a front steering bracket and are coupled to the front crossmember. A back left wheel and a back right when have a back steering bracket and are coupled to the back crossmember. A front wheel pod and a back wheel pod are coupled to the front steering bracket and the back steering bracket, respectively. Connection cables are coupled to the body and the front wheel pod and the back wheel pod. The body pivots to turn each of the front left wheel, the front right wheel, the back left wheel, and the back right wheel.

9 Claims, 8 Drawing Sheets

(56) References Cited

U.S. PATENT DOCUMENTS

2012/0286487 A1* 11/2012 Miroewski ..... A63H 17/262
280/47.11

* cited by examiner

STEERABLE TOY CAR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toy cars and more particularly pertains to a new toy car for providing an engaging toy for children.

(2) Description of Related Art Including Information Disclosed Under 37 CFR 1.97 and 1.98

The prior art relates to toy cars.

BRIEF SUMMARY OF THE INVENTION

An embodiment of the disclosure meets the needs presented above by generally comprising a body having a body front side, a body back side, a body top side, a body bottom side, a body left side, and a body right side. The body bottom side has a front cutout channel and a back cutout channel extending from the body left side through the body right side towards the body top side. A front crossmember and a back crossmember are pivotably coupled within the front cutout channel and the back cutout channel, respectively. A front left wheel and a front right wheel are coupled to the front crossmember. Each of the front left wheel and the front right wheel has a front steering bracket pivotably coupled to the front crossmember and a front wheel pod coupled to the front steering bracket. The front wheel pod has a front tire rotatably coupled within a front wheel well. A front left connection cable is coupled between the body left side and the front wheel pod of the front left wheel behind the front steering bracket. A front right connection cable is coupled between the body right side and the front wheel pod of the front right wheel behind the front steering bracket. A back left wheel and a back right wheel are coupled to the back crossmember. Each of the back left wheel and the back right wheel has a back steering bracket pivotably coupled to the back crossmember and a back wheel pod coupled to the back steering bracket. The back wheel pod has a back tire rotatably coupled within a back wheel well. A back left connection cable is coupled between the body left side and the back wheel pod of the back left wheel in front of the back steering bracket. A back right connection cable is coupled between the body right side and the back wheel pod of the back right wheel in front of the back steering bracket. The body pivots to turn each of the front left wheel, the front right wheel, the back left wheel, and the back right wheel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
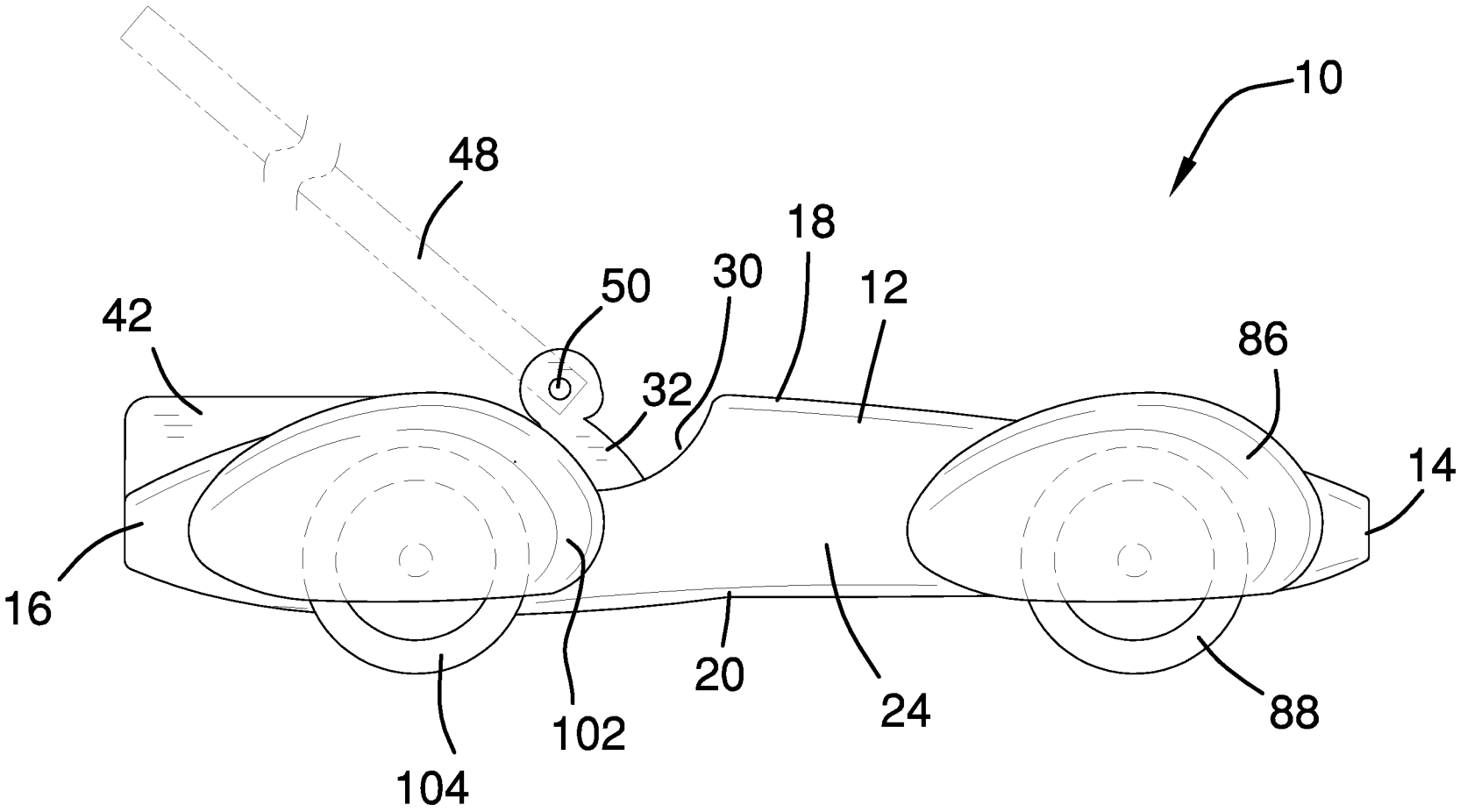
FIG. 1 is a front elevation view of a steerable toy car apparatus according to an embodiment of the disclosure.
Figure 3:
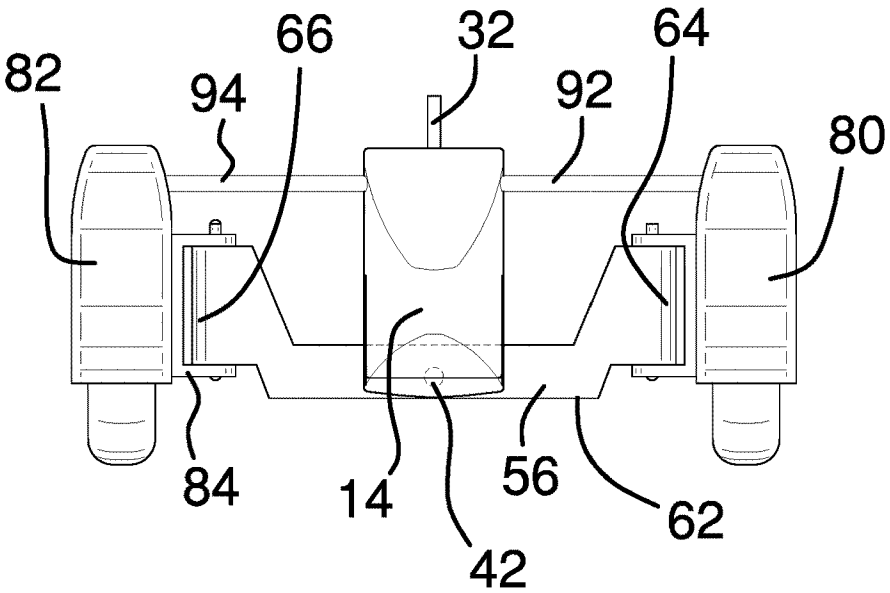
FIG. 3 is a front elevation view of an embodiment of the disclosure.
Figure 2:
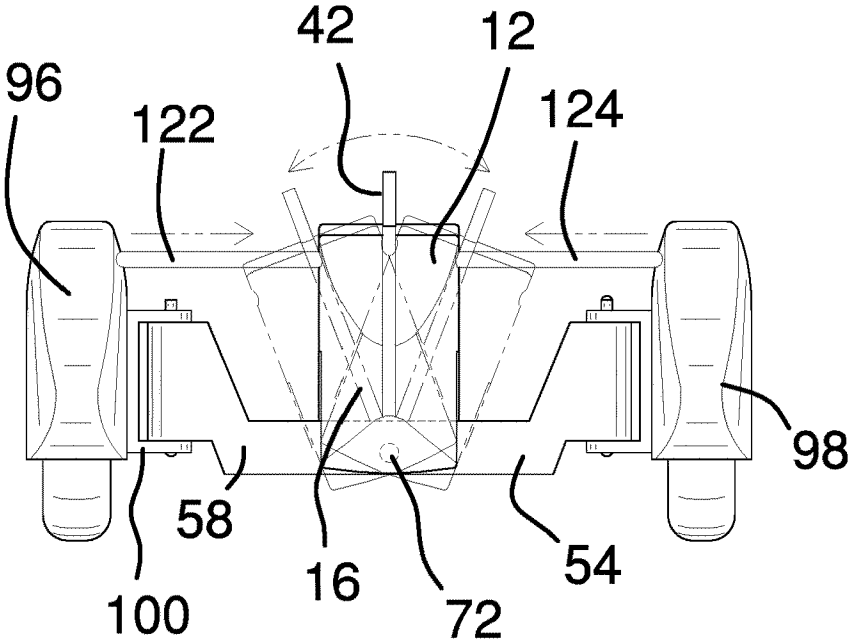
FIG. 2 is a rear elevation view of an embodiment of the disclosure.
Figure 4:
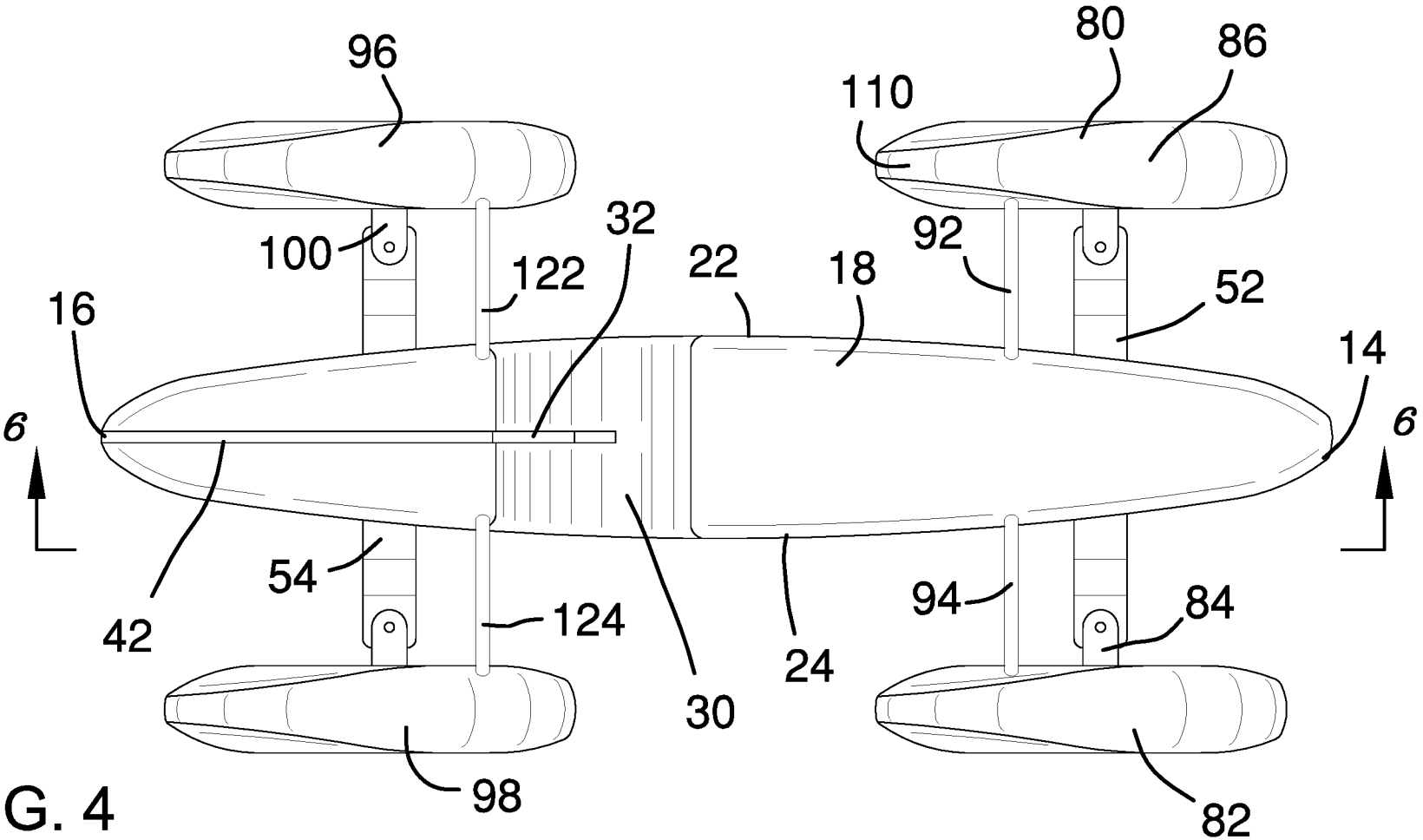
FIG. 4 is a top plan view of an embodiment of the disclosure.
Figure 5:
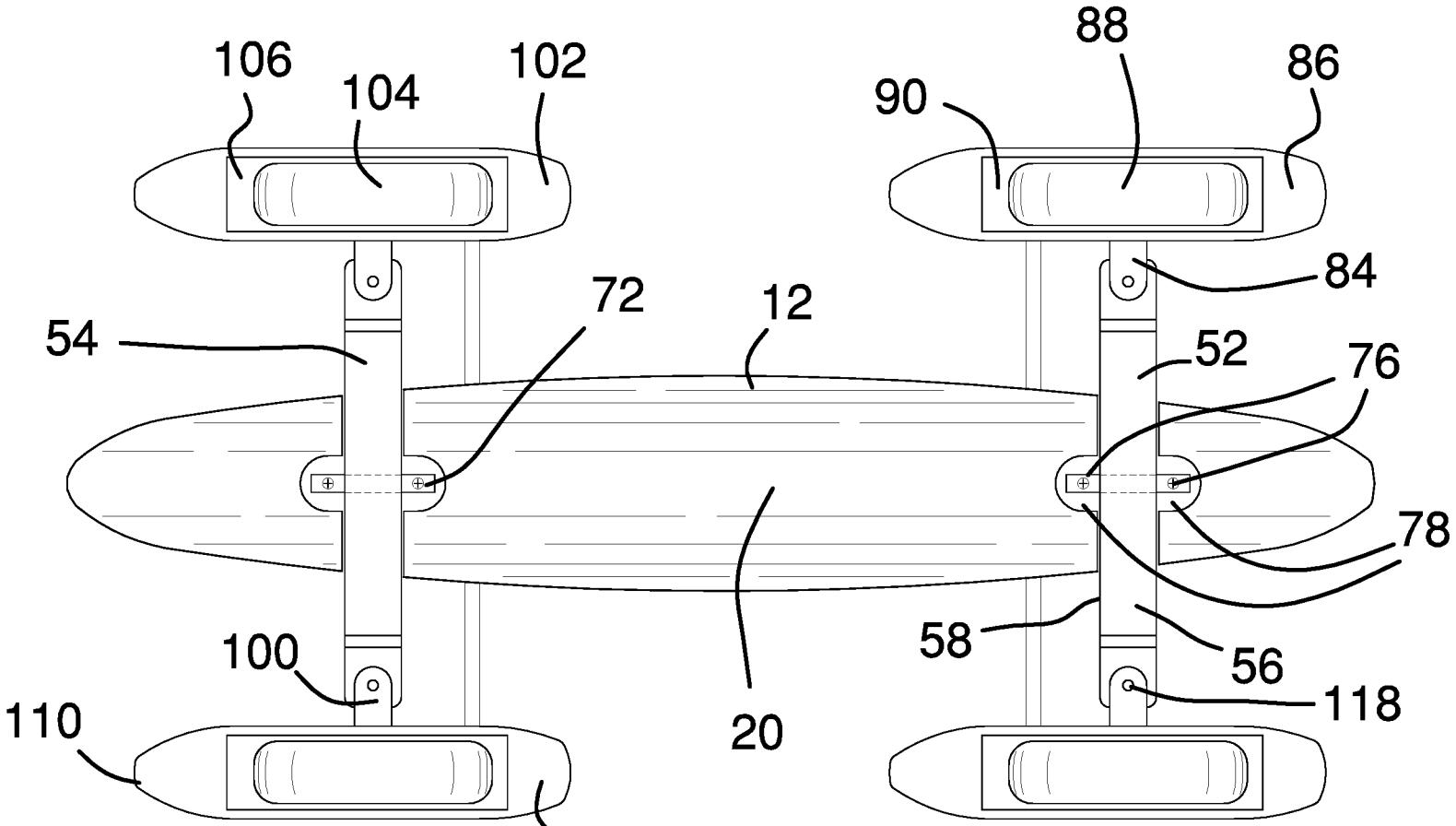
FIG. 5 is a bottom plan view of an embodiment of the disclosure.
Figure 6:
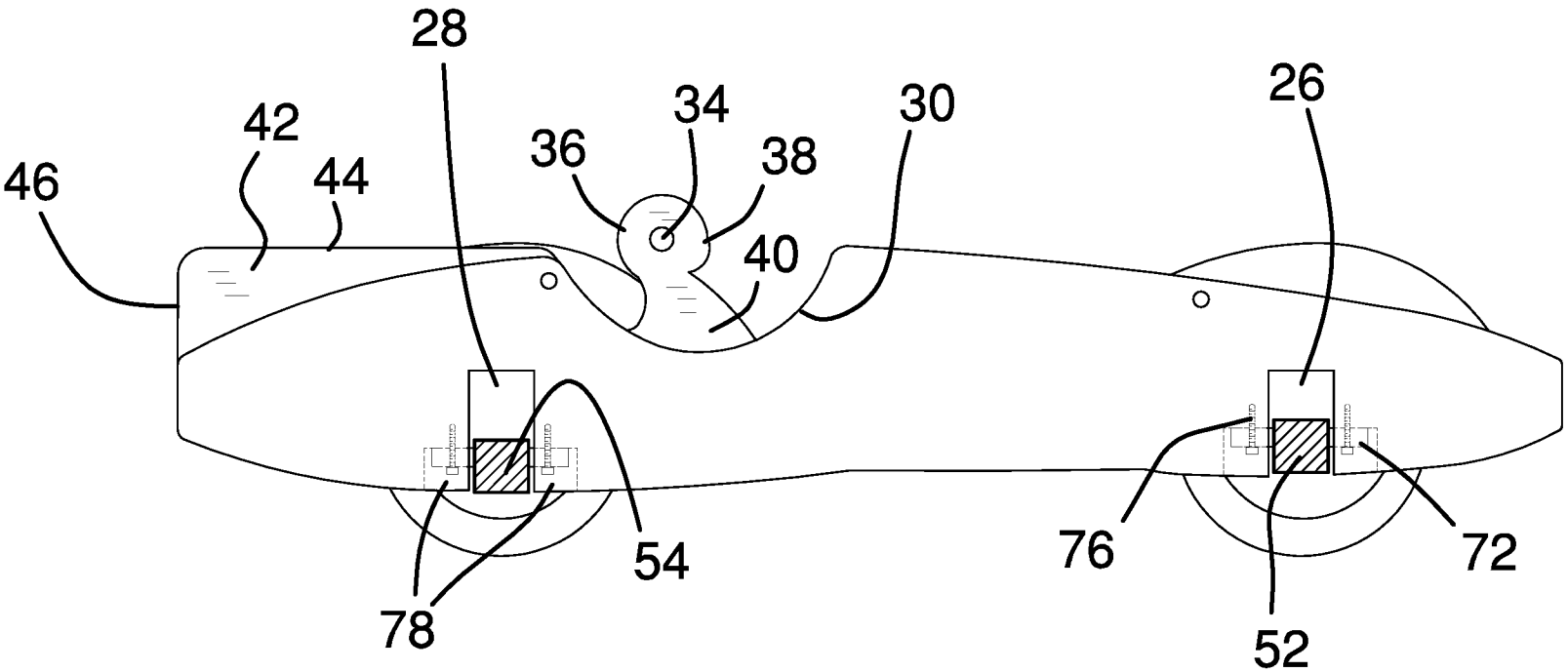
FIG. 6 is a cross-sectional view along the line 6-6 of FIG. 4 of an embodiment of the disclosure.
Figure 7:
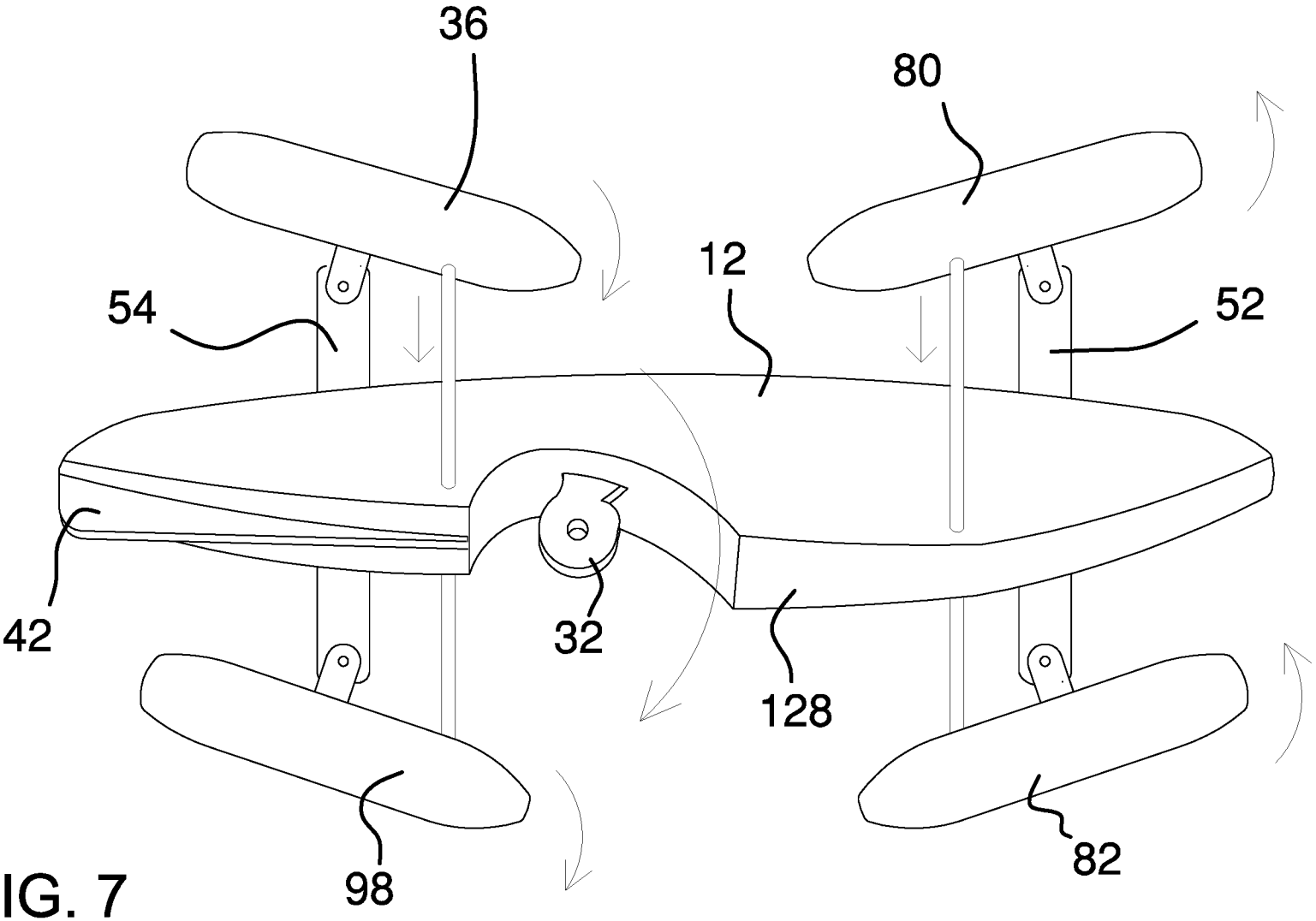
FIG. 7 is an in-use view of an embodiment of the disclosure.
Figure 8:
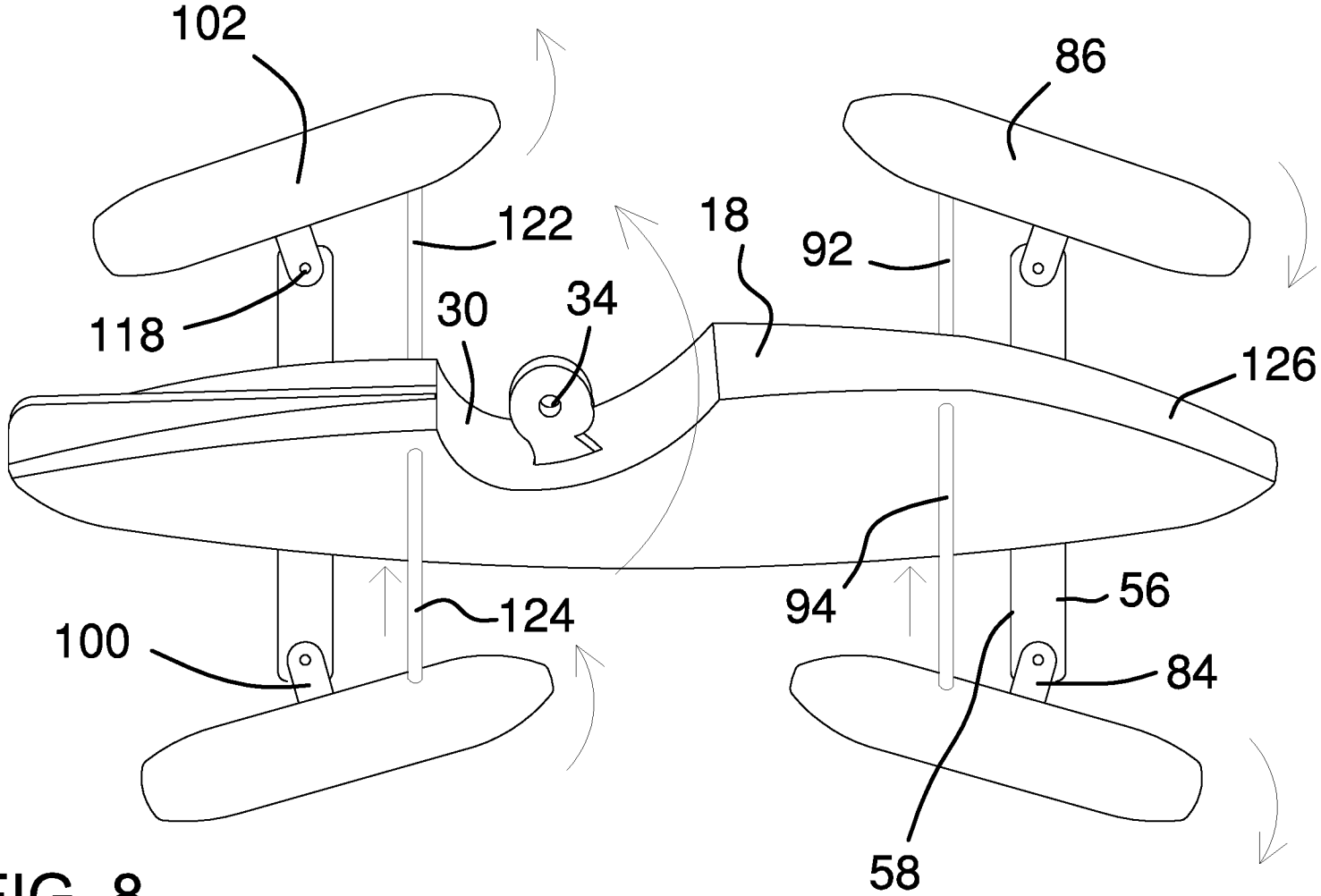
FIG. 8 is an in-use view of an embodiment of the disclosure.
Figure 9:
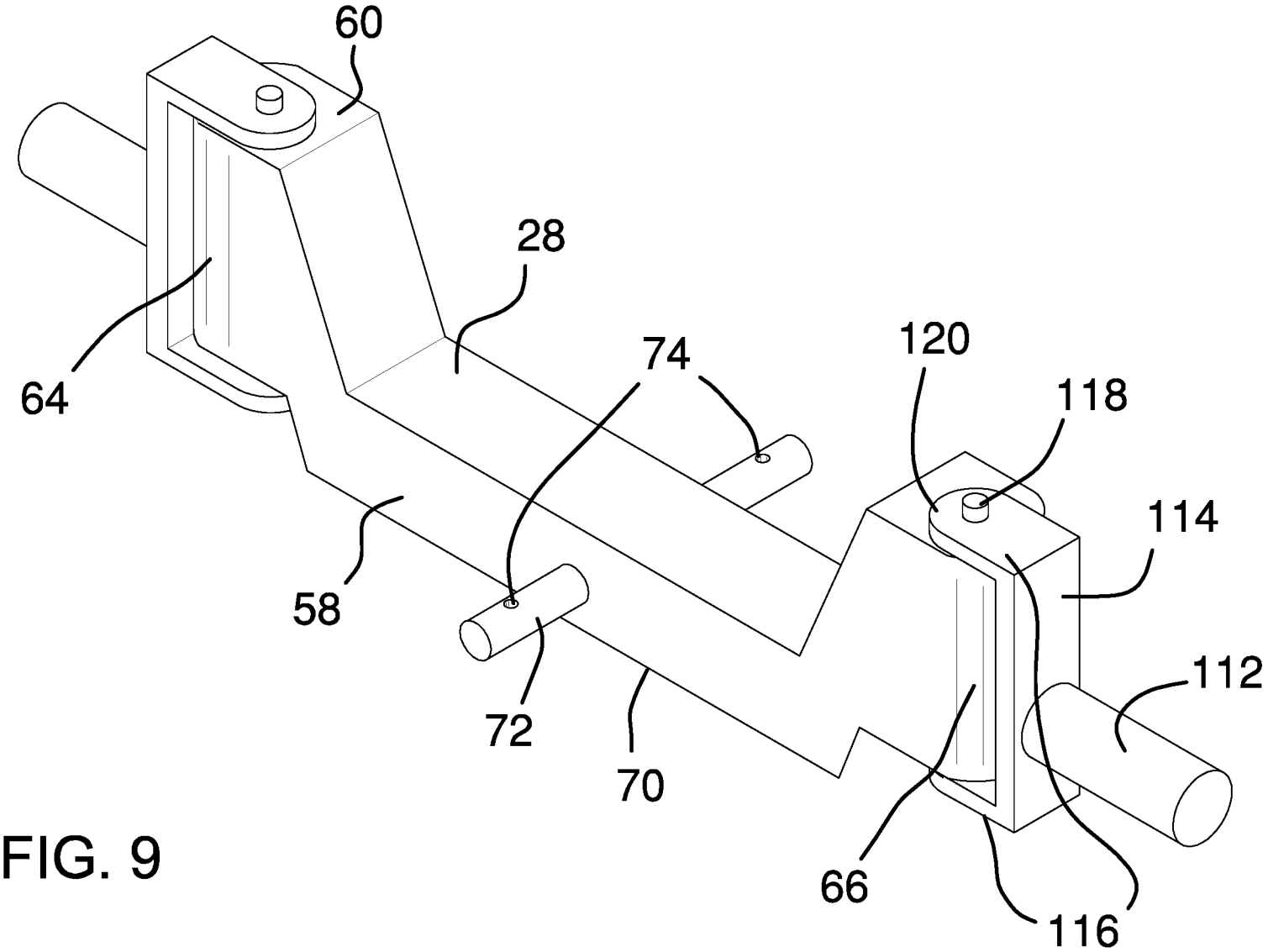
FIG. 9 is an isometric view of an embodiment of the disclosure.

With reference now to the drawings, and in particular to FIGS. 1 through 9 thereof, a new toy car embodying the principles and concepts of an embodiment of the disclosure and generally designated by the reference numeral 10 will be described.

As best illustrated in FIGS. 1 through 9, the steerable toy car apparatus 10 generally comprises a body 12 having a body front side 14, a body back side 16, a body top side 18, a body bottom side 20, a body left side 22, and a body right side 24. The body bottom side 20 has a front cutout channel 26 and a back cutout channel 28 extending from the body left side 22 through the body right side 24 towards the body top side 18. The body front side 14 and the body back side 16 are vertical. The body top side 18 is concave downwards excepting a rounded cockpit portion 30. A connection point 32 is coupled to the body top side 18 within the cockpit portion 30 and has a stick connection aperture 34 extending therethrough. The connection point 32 may have a profile 36 representing a head 38 and a chest 40 of a driver. The stick connection aperture 34 extends through the head 38. A fin 42 is coupled to the body top side 18. The fin 42 has a horizontal top edge 44 extending from behind the cockpit portion 30 and a vertical back edge 46 aligned with the body back side 16. A thickness of the fin 42 may be equal to a thickness of the connection point 32. A push stick 48 is coupled to the connection point 32. The push stick 48 has a connection screw 50 pivotably engageable through the stick connection aperture 34. The push stick 48 may be used to manipulate the apparatus 10 from a distance.

A front crossmember 52 and a back crossmember 54 are pivotably coupled within the front cutout channel 26 and the back cutout channel 28, respectively. Each of the front crossmember 52 and the back crossmember 54 has a crossmember front side 56, a crossmember backside 58, a crossmember top side 60, a crossmember bottom side 62, a crossmember left side 64, and a crossmember right side 66. The crossmember left side 64 and the crossmember right 66 side may be rounded to prevent interference. The crossmember top side 60 has a medial trapezoidal depressed portion 68 and the crossmember bottom side 62 has a medial trapezoidal extended portion 70. Each of the front crossmember 52 and the back crossmember 54 has a body pivot rod 72 pivotably coupled from the crossmember front side 56 through the crossmember backside 58. The body pivot rod 72 has a pair of attachment apertures 74 to receive a pair of attachment screws 76 to fix the body pivot rod 72 to each side of the front cutout channel 26 or the back cutout channel 28, respectively. The body bottom side 20 may have a pair of rounded pivot depressions 78 on each side of each of the front cutout channel 26 and the back cutout channel 28 to accommodate the body pivot rod 72. A front left wheel 80 and a front right wheel 82 are coupled to the front crossmember 52. Each of the front left wheel 80 and the front right wheel 82 has a front steering bracket 84 pivotably coupled to the front crossmember 52 and a front wheel pod 86 coupled to the front steering bracket 84. The front wheel pod 86 has a front tire 88 rotatably coupled within a front wheel well 90. A front left connection cable 92 is coupled between the body left side 22 and the front wheel pod 86 of the front left wheel 80 behind the front steering bracket 84. A front right connection cable 94 is coupled between the body right side 24 and the front wheel pod 86 of the front right wheel 82 behind the front steering bracket 84. A back left wheel 96 and a back right wheel 98 are coupled to the back crossmember 54. Each of the back left wheel 96 and the back right wheel 98 has a back steering bracket 100 pivotably coupled to the back crossmember 54 and a back wheel pod 102 coupled to the back steering bracket 100. The back wheel pod 102 has a back tire 104 rotatably coupled within a back wheel well 106. Each of the front wheel pods 86 and the back wheel pods 102 may have a horizontal pod bottom side 108 and a tapered pod back side 110.

Each of the back steering brackets 100 and the front steering brackets 84 has an axle portion 112 and a forked portion 114. A pair of arms 116 of the forked portion 114 is pivotably coupled to a steering pivot rod 118 extending from the crossmember top side 60 through the crossmember bottom side 62. A distal end 120 of each of the arms 116 may be rounded. The axle portion 112 extends into the front wheel well 90 or the back wheel well 106, respectively. The front tire 88 and the back tire 104 are coupled to the axle portion 112 within the respective front wheel well 90 or the back wheel well 106. A back left connection cable 122 is coupled between the body left side 22 and the back wheel pod 102 of the back left wheel 96 in front of the back steering bracket 100. A back right connection cable 124 is coupled between the body right side 24 and the back wheel pod 102 of the back right wheel 98 in front of the back steering bracket 100. Pivoting the body 12 turns each of the front left wheel 80, the front right wheel 82, the back left wheel 96, and the back right wheel 98.

In use, the connection point 32 is manipulated either by hand or with the push stick 48 to push the apparatus 10 along the ground. As the body 12 is angled to a side, the front left connection cable 92, the front right connection cable 94, the back left connection cable 122, and the back right connection cable 124 apply force to the respective front wheel pods 86 and the back wheel pods 102 to pivot on the front crossmember 52 and the back crossmember 54 to steer the apparatus 10. As the body 12 is angled to a left leaning position 126 the apparatus 10 steers to the right and as the body is angled to a right leaning position 128 the apparatus 10 steers to the left.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A steerable toy car apparatus comprising:

a body, the body having a body front side, a body back side, a body top side, a body bottom side, a body left side, and a body right side, the body bottom side having a front cutout channel and a back cutout channel extending from the body left side through the body right side towards the body top side;

a front crossmember and a back crossmember coupled to the body, the front crossmember and the back crossmember being pivotably coupled within the front cutout channel and the back cutout channel, respectively;

a front left wheel and a front right wheel coupled to the front crossmember, each of the front left wheel and the front right wheel having a front steering bracket pivotably coupled to the front crossmember and a front wheel pod coupled to the front steering bracket, the front wheel pod having a front tire rotatably coupled within a front wheel well;

a front left connection cable coupled between the body left side and the front wheel pod of the front left wheel behind the front steering bracket;

a front right connection cable coupled between the body right side and the front wheel pod of the front right wheel behind the front steering bracket;

a back left wheel and a back right wheel coupled to the back crossmember, each of the back left wheel and the back right wheel having a back steering bracket pivotably coupled to the back crossmember and a back wheel pod coupled to the back steering bracket, the back wheel pod having a back tire rotatably coupled within a back wheel well;

a back left connection cable coupled between the body left side and the back wheel pod of the back left wheel in front of the back steering bracket; and a back right connection cable coupled between the body right side and the back wheel pod of the back right wheel in front of the back steering bracket;

wherein pivoting the body turns each of the front left wheel, the front right wheel, the back left wheel, and the back right wheel.

2. The steerable toy car apparatus of claim 1 further comprising a connection point coupled to the body, the connection point being coupled to the body top side, the connection point having a stick connection aperture extending therethrough; a push stick having a connection screw pivotably engageable through the stick connection aperture.

3. The steerable toy car apparatus of claim 2 further comprising the connection point having a profile representing a head and a chest of a driver, the stick connection aperture extending through the head.

4. The steerable toy car apparatus of claim 1 further comprising the body front side and the body back side being vertical, the body top side being concave downwards excepting a rounded cockpit portion.

5. The steerable toy car apparatus of claim 4 further comprising a fin coupled to the body top side, the fin having a horizontal top edge extending from behind the cockpit portion and a vertical back edge aligned with the body back side.

6. The steerable toy car apparatus of claim 1 further comprising each of the front crossmember and the back crossmember having a crossmember front side, a crossmember backside, a crossmember top side, a crossmember bottom side, a crossmember left side, and a crossmember right side, the crossmember top side having a medial trapezoidal depressed portion and the crossmember bottom side having a medial trapezoidal extended portion, each of the front crossmember and the back crossmember having a body pivot rod pivotably coupled from the crossmember front side through the crossmember backside, the body pivot rod having a pair of attachment apertures to receive a pair of attachment screws to fix the body pivot rod to each side of the front cutout channel or the back cutout channel, respectively.

7. The steerable toy car apparatus of claim 6 further comprising the crossmember left side and the crossmember right side being rounded.

8. The steerable toy car apparatus of claim 6 further comprising each of the back steering brackets and the front steering brackets having an axle portion and a forked portion, a pair of arms of the forked portion being pivotably coupled to a steering pivot rod extending from the crossmember top side through the crossmember bottom side, the axle portion extending into the front wheel well or the back wheel well, respectively, the front tire and the back tire being coupled to the axle portion within the respective front wheel well or the back wheel well.

9. A steerable toy car apparatus comprising:

a body, the body having a body front side, a body back side, a body top side, a body bottom side, a body left side, and a body right side, the body bottom side having a front cutout channel and a back cutout channel extending from the body left side through the body right side towards the body top side, the body front side and the body back side being vertical, the body top side being concave downwards excepting a rounded cockpit portion;

a connection point coupled to the body, the connection point being coupled to the body top side within the cockpit portion, the connection point having a stick connection aperture extending therethrough, the connection point having a profile representing a head and a chest of a driver, the stick connection aperture extending through the head;

a fin coupled to the body top side, the fin having a horizontal top edge extending from behind the cockpit portion and a vertical back edge aligned with the body back side;

a push stick coupled to the connection point, the push stick having a connection screw pivotably engageable through the stick connection aperture;

a front crossmember and a back crossmember coupled to the body, the front crossmember and the back crossmember being pivotably coupled within the front cutout channel and the back cutout channel, respectively, each of the front crossmember and the back crossmember having a crossmember front side, a crossmember backside, a crossmember top side, a crossmember bottom side, a crossmember left side, and a crossmember right side, the crossmember left side and the crossmember right side being rounded, the crossmember top side having a medial trapezoidal depressed portion and the crossmember bottom side having a medial trapezoidal extended portion, each of the front crossmember and the back crossmember having a body pivot rod pivotably coupled from the crossmember front side through the crossmember backside, the body pivot rod having a pair of attachment apertures to receive a pair of attachment screws to fix the body pivot rod to each side of the front cutout channel or the back cutout channel, respectively;

a front left wheel and a front right wheel coupled to the front crossmember, each of the front left wheel and the front right wheel having a front steering bracket pivotably coupled to the front crossmember and a front wheel pod coupled to the front steering bracket, the front wheel pod having a front tire rotatably coupled within a front wheel well;

a front left connection cable coupled between the body left side and the front wheel pod of the front left wheel behind the front steering bracket;

a front right connection cable coupled between the body right side and the front wheel pod of the front right wheel behind the front steering bracket;

a back left wheel and a back right wheel coupled to the back crossmember, each of the back left wheel and the back right wheel having a back steering bracket pivotably coupled to the back crossmember and a back wheel pod coupled to the back steering bracket, the back wheel pod having a back tire rotatably coupled within a back wheel well;

each of the back steering brackets and the front steering brackets having an axle portion and a forked portion, a pair of arms of the forked portion being pivotably coupled to a steering pivot rod extending from the crossmember top side through the crossmember bottom side, the axle portion extending into the front wheel well or the back wheel well, respectively, the front tire and the back tire being coupled to the axle portion within the respective front wheel well or the back wheel well;

a back left connection cable coupled between the body left side and the back wheel pod of the back left wheel in front of the back steering bracket; and a back right connection cable coupled between the body right side and the back wheel pod of the back right wheel in front of the back steering bracket;

wherein pivoting the body turns each of the front left wheel, the front right wheel, the back left wheel, and the back right wheel.

* * * * *